United States Patent [19]

Horvath, Jr.

[11] 3,964,689

[45] June 22, 1976

[54] HOSE-END DISPENSER DEVICE

[75] Inventor: Stephen R. Horvath, Jr., Racine, Wis.

[73] Assignee: S. C. Johnson & Son, Inc., Racine, Wis.

[22] Filed: Apr. 10, 1975

[21] Appl. No.: 567,029

[52] U.S. Cl. ..... 239/318; 239/375; 239/428.5; 239/432; 239/530

[51] Int. Cl.[2] ..... B05B 7/30

[58] Field of Search ..... 239/311, 428.5, 318, 239/375, 530, 343, 432, 458; 222/465; 215/1 C

[56] References Cited

UNITED STATES PATENTS

| | | | |
|---|---|---|---|
| 2,126,718 | 8/1938 | Batenburg | 239/530 X |
| 2,347,476 | 4/1944 | Graham | 239/458 |
| 2,686,694 | 8/1954 | Freeman | 239/530 X |
| 2,737,413 | 3/1956 | Mitchison | 239/311 |
| 3,092,330 | 6/1963 | Ridenour et al. | 239/375 X |

*Primary Examiner*—John J. Love

[57] ABSTRACT

A hose-end dispenser device including a container with an outlet opening, a handle extending along the container adjacent the opening, a rigid tube for carrier fluid flow overlying the handle and the opening and having insulating means thereon along the handle, a fluid connection from the container into the tube through the opening of the container, and a discharge means at one end of the tube. Preferred embodiments are characterized by radially extending thermally non-conductive fins on the rigid tube to form the insulating means, and/or a foaming nozzle of particular configuration forming the discharge means.

5 Claims, 5 Drawing Figures

HOSE-END DISPENSER DEVICE

BACKGROUND OF THE INVENTION

This invention relates to the field of hose-end dispenser devices and in particular to such devices which include a bottle or other container attached in some way to the end of a hose which provides a carrier stream for product aspirated or otherwise discharged from within the container.

A wide variety of hose-end dispensers have been used for dispensing various chemical substances such as fertilizers, weed killers and cleaning compositions, Such substances are dispensed in a variety of forms including mists, foams and jet streams. In many such devices, a carrier fluid such as water is supplied through a hose, such as a garden hose. The chemical substance to be dispensed is contained in a bottle and is drawn into the carrier stream by aspiration or is forced into the stream by pressure. Then both carrier stream and product are discharged through a nozzle of some kind.

Devices of this type offer a convenient method of applying useful compositions for various purposes onto a variety of surfaces. The popularity of such dispensing systems is well-established. However, many devices of the type described have exhibited significant problems.

One problem which has been experienced is difficulty in application of the discharged product when the device is held by hand. This is particularly true when product is being applied over a large area such that the operator must move himself and/or his arm and hand during application. As the operator moves, a tug which is variable both in degree and direction is exerted on the nozzle by the hose, which typically is not or cannot be gripped in one hand together with the product container. Further, with many products exceedingly hot water, steam, or some other hot fluid is used as the carrier fluid, such that an operator cannot readily grasp the hose to lessen the variableness in the annoying tug experienced during application.

Brief Description of the Invention

This invention overcomes the aforementioned problems by providing a rigid tube for carrier fluid flow which overlies a container handle adjacent the container opening. The tube has thermal insulating means on the portion adjacent the container handle. With this invention, an operator may grasp both the rigid tube (which is an extension of a hose) and the container handle in one hand, even though the carrier fluid is of a very high temperature. This configuration reduces or eliminates the aforementioned problem of controlling the device during product application.

Radially extending thermally non-conductive fins closely spaced along the rigid tube at that portion adjacent the handle provide a superior and highly preferred insulation means to enable gripping by an operator's hand. Other features of this invention relate to an adjustable foam dispensing nozzle and cone which can vary the spray pattern significantly without significantly changing the foam characteristics. This feature is described in detail hereinafter. The preferred embodiments of this invention are particularly useful for dispensing grease-cutting chemicals in a stream of near-boiling water for the purpose of cleaning a greasy meat room without the necessity of a wipe-down operation. The invention has shown itself to be remarkably easy to use in such application in spite of the exceedingly hot temperatures of the discharge stream and the large area of application requiring the operator to drag the hose over a large area.

OBJECTS OF THE INVENTION

One object of this invention is to provide a hose-end dispenser device which is characterized by ease of product application even though significant movement is required during application.

Another object of this invention is to provide a device of the type described which may be hand held although the carrier fluid used has a very high temperature.

Another object of this invention is to provide a superior hose-end dispenser device of the type described having a discharge nozzle means which is useful in applying a foam pattern of varying width.

BRIEF DESCRIPTION OF THE DRAWINGS

These and other objects of the invention will be apparent from the following description of preferred embodiments, including the figures wherein.

DETAILED DESCRIPTION OF PREFERRED EMBODIMENTS

Figure 1:
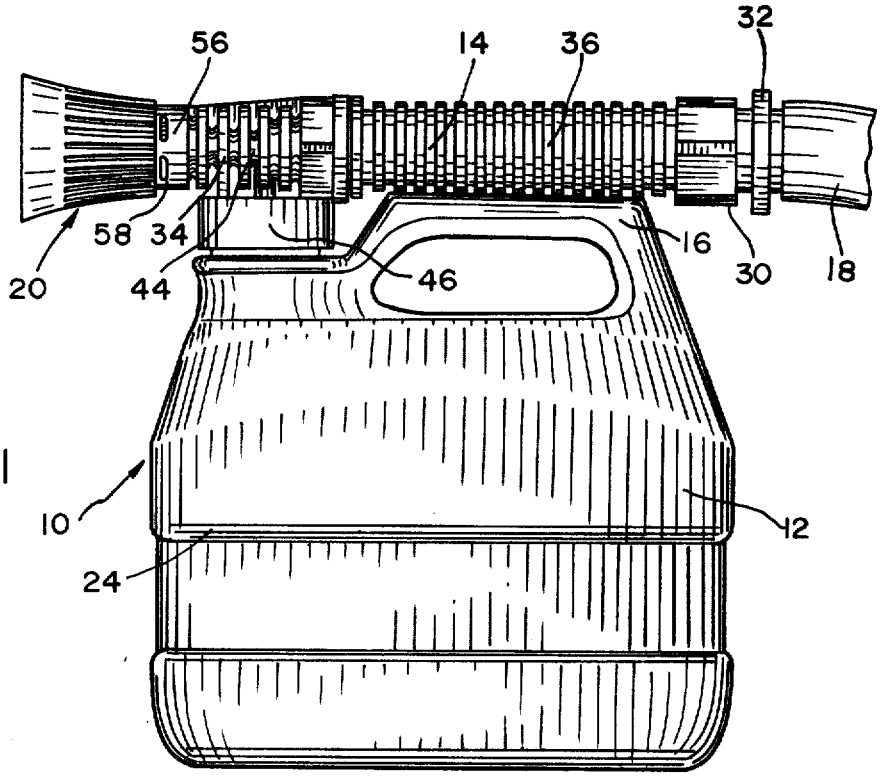
FIG. 1 is a side elevation of a hose-end dispenser device of this invention.

The figures illustrate hose-end dispenser device 10 including a container 12, a rigid tube 14 overlying a handle 16 of container 12 and forming an extension of hose 18, and a nozzle means 20 attached to the end of rigid tube 14.

Figure 2:
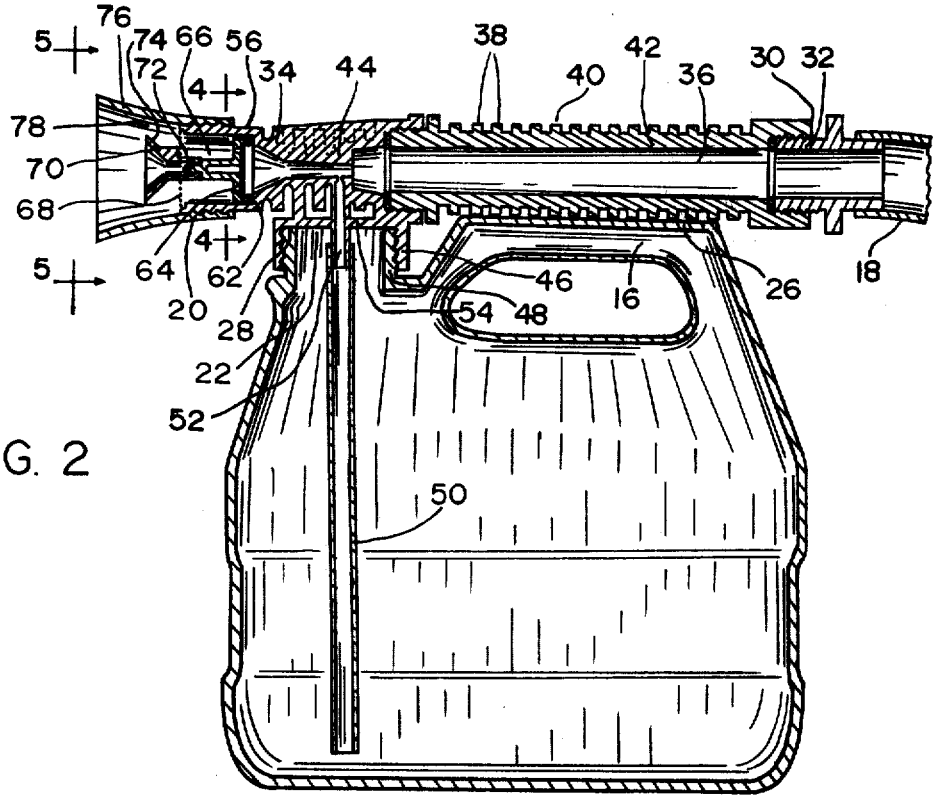
FIG. 2 is a side sectional view as indicated by Section 2—2 in FIG. 3.
Figure 3:
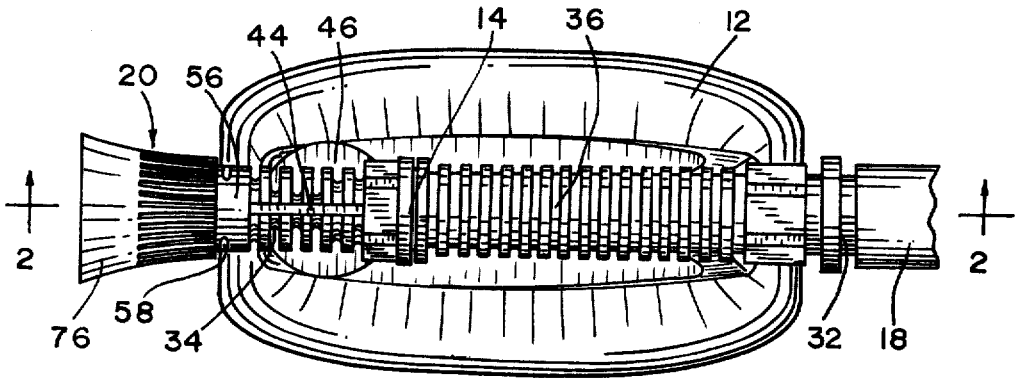
FIG. 3 is a top plan view.
Figure 4:
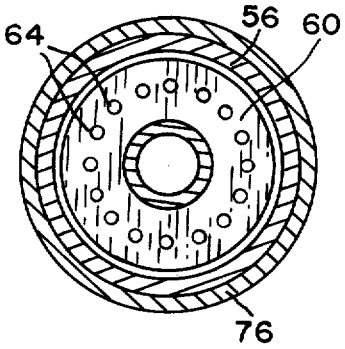
FIG. 4 is a sectional view of a portion of the device, specifically the discharge means, as indicated by Section 4—4 in FIG. 2.
Figure 5:
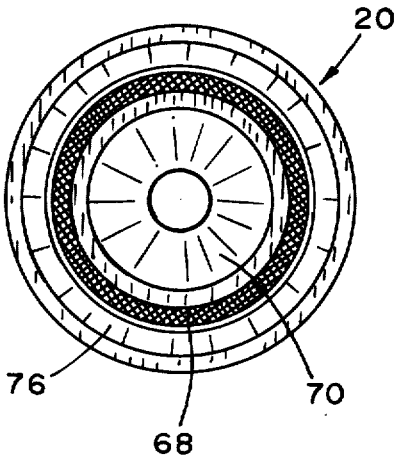
FIG. 5 is a front view of the discharge means portion of the device as indicated by line 5—5 shown in FIG. 2.

Container 12 defines an outlet opening 22 at one side of the upper surface thereof. Handle 16 of container 12 is rigidly attached to main portion 24 of container 12; indeed, in this embodiment handle 16 is integrally formed with the container. Handle 16 extends along the upper portion of container 12 adjacent outlet opening 22. The upper surface 26 of handle 16 is substantially coplanar with the upper edge 28 of outlet opening 22, as shown in FIG. 2.

Rigid tube 14 overlies handle 16 and outlet opening 22. Tube 16 has a first end 30 having a hose attachment means 32, and a second end 34 to which nozzle discharge means 20 is connected. A central portion 36 of rigid tube 14 extends along handle 16 and has radially extending thermally non-conductive fins spaced therealong to form a thermal insulating means. Fins 38 are integrally formed with rigid tube 14, the structure preferably being made of a plastic material of low thermal conductivity. Examples are expanded polypropylene, nylon and acetal resin, sold under the trademark CELCON. Fins 38 are closely spaced along central portion 36. The spacing is such that the radially outermost surfaces 40 of fins 38 together form a grip for tube 14 which prevents the operator's hand from contacting base portion 42 of tube 14, which may be much hotter than outermost surfaces 40 by virtue of its proximity to the fluid stream within tube 14.

Various other kinds of insulating means may be used along central portion 36. However, it has been found that the integral ribbed configuration functions very well so that rigid tube 14 may readily be grasped by an operator's hand.

Rigid tube 14 is adjacent handle 16 so that they may be grasped together by an operator's hand, thus giving the operator control of both hose 18 and container 12.

Integrally molded with a forward portion 44 of rigid tube 14 is a container closure 46 which is threaded to engage a neck portion 48 of container 12, which defines outlet opening 22. Closure 46 has an upper surface 54 which is substantially coplaner with upper surface 26 of handle 16. Tube 14 is attached to container 12 by means of closure 46. Depending from closure 46 is a dip tube 50 which is designed to extend into a fluid product within container 12. Closure 46 and tube 14 define an aperture 52 which, together with dip tube 50, forms a fluid communication means from container 12 to the inside of tube 14. As carrier fluid flows from hose 18 through tube 14, fluid product within container 12 is aspirated through dip tube 50 and aperture 52 into the carrier stream, and thereafter discharged through nozzle means 20.

Nozzle means 20 is designed to provide a discharge of foam which may be adjusted to varying spray patterns. Nozzle means 20 includes a fixed cylindrical member 56 which forms an extension of tube 14 and is integrally molded therewith. Fixed cylindrical member 56 defines lateral air inlets 58 through which air is drawn into the product stream. Nozzle means 20 also includes an insert piece 60 axially centered within cylindrical member 56 and sealed across the flow pad by means of an O-ring 62 to restrict the flow. The flow restriction is at a point upstream of air inlets 58. Insert piece 60 defines restricted flow orifices 64 upstream of air inlets 58. Downstream of insert piece 60, but within fixed cylindrical member 56, is a mixing chamber 66 within which the air and fluid stream may form a foam. Mixing chamber 66 is further defined by a screen 68 through which the foam passes from mixing chamber 66.

Nozzle means 20 also includes a cone shaped deflector member 70 attached to insert piece 60 by a snap connection 72. Deflector member 70 is in axial alignment with fixed member 56 and includes an outside flow deflecting surface 74 flaring radially outwardly (in a downstream direction) at a point downstream of both air inlets 58 and mixing chamber 66. An axially adjustable, outwardly flaring in a downstream direction nozzle member 76 is threaded to cylindrical member 56. An annular flow channel 78 is defined between nozzle member 76 and deflector member 70. The size and configuration of annular flow channel 78 is adjusted by the axial position of nozzle member 78 with respect to deflector member 70, to control the spray pattern of foam which is discharged from nozzle means 20. When nozzle member 76 is fully extended, the spray pattern will be narrow and when it is fully retracted the spray pattern will be wide.

The materials which may be used in making the various parts of this invention would be obvious to those skilled in the art who are familiar with the invention. Container 12, tube 14, and the members of nozzle means 20 are preferably molded of a familiar variety of plastic materials.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. A hose-end dispenser device comprising:

a container defining an outlet opening;

a handle rigidly attached to said container and extending therealong adjacent said opening;

a rigid tube for carrier fluid flow overlying said handle and said opening, said tube having two ends and having insulating means along said handle;

fluid connection means from said container into said tube via said opening;

hose attachment means at one end of said tube; and discharge means at the other end of said tube, said discharge means comprising a fixed cylindrical member forming an extension of said tube, said fixed member defining at least one lateral air inlet; an insert piece within said cylindrical member restricting the flow through said fixed member, said piece defining at least one restricted flow orifice upstream of said at least one air inlet; a cone-shaped deflector member attached to said insert piece in axial alignment with said fixed member and having an outside flow deflecting surface flaring radially outwardly in a downstream direction at a point downstream of said at least one air inlet; and an axially adjustable outwardly flaring nozzle member connected to said fixed member, said axial adjustability varying the size of an annular flow channel between said nozzle and said flow deflecting surface to provide foam spray patterns of varying width.

2. The device of claim 1 wherein said insulating means comprises a multiplicity of radially extending thermally nonconductive fins formed on said rigid tube, each of said fins having a radially outermost surface, said surfaces together forming a grip for said tube.

3. The device of claim 2 including a container closure defining said opening, said closure having an upper surface substantially in the same plane as the surface of said handle which said rigid tube overlies.

4. The device of claim 3 wherein the portion of said tube overlying said opening is integrally formed with said closure.

5. The device of claim 4 wherein said handle is integrally formed with said container.

* * * * *